US009209576B2

(12) United States Patent
Lee

(10) Patent No.: US 9,209,576 B2
(45) Date of Patent: Dec. 8, 2015

(54) POLARITY-CORRECTLY-CONNECTABLE INTELLIGENT INSERT-TO-CONNECT DEVICE

(71) Applicant: XYZ SCIENCE CO., LTD., New Taipei (TW)

(72) Inventor: Chiu-San Lee, New Taipei (TW)

(73) Assignee: XYZ Science Co., Ltd., New Taipei (TW)

( * ) Notice: Subject to any disclaimer, the term of this patent is extended or adjusted under 35 U.S.C. 154(b) by 56 days.

(21) Appl. No.: 14/259,123

(22) Filed: Apr. 22, 2014

(65) Prior Publication Data

US 2015/0303626 A1 Oct. 22, 2015

(51) Int. Cl.
*H01R 3/00* (2006.01)
*H01R 13/66* (2006.01)
*H01R 24/78* (2011.01)

(52) U.S. Cl.
CPC ..... *H01R 13/6691* (2013.01); *H01R 24/78* (2013.01)

(58) Field of Classification Search
CPC ..... H01R 13/6691; H01R 24/78
USPC ..... 439/488–490, 535
See application file for complete search history.

(56) References Cited

U.S. PATENT DOCUMENTS

| | | | | |
|---|---|---|---|---|
| 4,094,565 | A * | 6/1978 | Parrier et al. | 439/106 |
| 6,350,148 | B1 * | 2/2002 | Bartolutti et al. | 439/489 |
| 6,688,908 | B2 * | 2/2004 | Wallace | 439/490 |
| 8,210,866 | B2 * | 7/2012 | Inage et al. | 439/490 |
| 9,054,464 | B1 * | 6/2015 | Lin | 1/1 |

* cited by examiner

*Primary Examiner* — Khiem Nguyen
(74) *Attorney, Agent, or Firm* — Leong C. Lei

(57) ABSTRACT

The present invention includes an insert-to-connect device body, which receives therein a grounding terminal, a transmission terminal arranged at the left side of the grounding terminal, and a conduction terminal arranged at the right side of the grounding terminal. The grounding terminal is electrically connected with a grounding bulb. The transmission terminal is electrically connected with a transmission bulb. The conduction terminal is electrically connected with a conduction bulb. The conduction terminal is electrically connected with a conduction touch-plate. With such an arrangement, a construction operator is allowed, in installing the present invention, to follow instructions for connection with polarity correctness and to identify if the polarities are set correct according to lighting of the grounding bulb, the transmission bulb and the conduction bulb and touching of the conduction touch-plate.

9 Claims, 16 Drawing Sheets

POLARITY-CORRECTLY-CONNECTABLE INTELLIGENT INSERT-TO-CONNECT DEVICE

TECHNICAL FIELD OF THE INVENTION

The present invention generally relates to an intelligent receptacle adaptor, and more particularly to a polarity-correctly-connectable intelligent receptacle adaptor that is capable of inspecting polarities of power source, guiding a user to make correct connection, and enhancing safety.

DESCRIPTION OF THE PRIOR ART

The issue of influence of human body caused by electromagnetic radiation has been widely discussed in the medical field. A conventional insert-to-connect device often has an area of use that is of a two rectangle configuration or a two circle configuration and this easily leads to incorrect connection of the neutral wire N pole and the fire wire L pole. Further, it is generally impossible to identify the polarities of the conventional insert-to-connect device from the outside appearance thereof without the help of instrument. Thus, it often occurs that connection is made in a straightforward manner without identifying the polarities in advance. When the poles are connected incorrectly, electromagnetic waves and radioactive dusts may be caused, or electrical leaking may occur to hurt a user.

When the conventional insert-to-connect device is in a two rectangle configuration or a two circle configuration, the neutral wire N pole and the grounding line E pole are connected. When events, such as lightning stroke, cause an electrical surges passing through the conventional insert-to-connect device, the grounding wire E pole conducts the electrical surges or leaking currents to the earth to reduce the effect of lightning stroke for protecting people from being damaged thereby. Thus, if the neutral wire N pole and the fire wire L pole are connected in correctly, there may be damages.

SUMMARY OF THE INVENTION

An object of the present invention is to detect if the polarities of a power source are correctly connected.

Another object of the present invention is to provide reminders of the polarities connected.

A further object of the present invention is to reduce electromagnetic wave and radioactive dusts and to prevent electrical shock.

To achieve the above objects, the present invention comprises an insert-to-connect device body that receives therein at least one grounding terminal serving as E pole, at least one transmission terminal arranged at the left side of the grounding terminal, and at least one conduction terminal arranged at the right side of the grounding terminal. The insert-to-connect device body further comprises at least one universal surface panel for receiving the insertion of standard plugs of various countries, such as South Africa, so as to have the standard plugs to electrically connect with the grounding terminal, the transmission terminal, or the conduction terminal. The conduction terminal is electrically connected with at least one conduction touch-plate and the conduction terminal is electrically connected with at least one conduction bulb. The transmission terminal is electrically connected with at least one transmission bulb. The grounding terminal is electrically connected with at least one grounding bulb. When the present invention is connected to a power source having a voltage level of 250V, the transmission terminal is (left side) N pole and the conduction terminal is (right side) L pole; and when the present invention is connected to a power source having a voltage level of 125V, the transmission terminal is (left side) L pole and the conduction terminal is (right side) N pole. Further, when the insert-to-connect device body is electrically connected with a power source, if the grounding bulb is lit up, it is determined that E pole of the power source is correctly set in position; if the transmission bulb is lit up, it is determined that N pole of the power source is correctly set in position; and if the conduction bulb is lit up after the conduction touch-plate is touched, it is determined that L pole of the power source is correctly set in position, whereby on-site detection can be performed and detection and identification can be done for determining if the connection of electrical polarity of the power source made by an installation operator is correct so as to allow the present invention and the power source to be connected with polarity correctness.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

The following descriptions are exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1A:
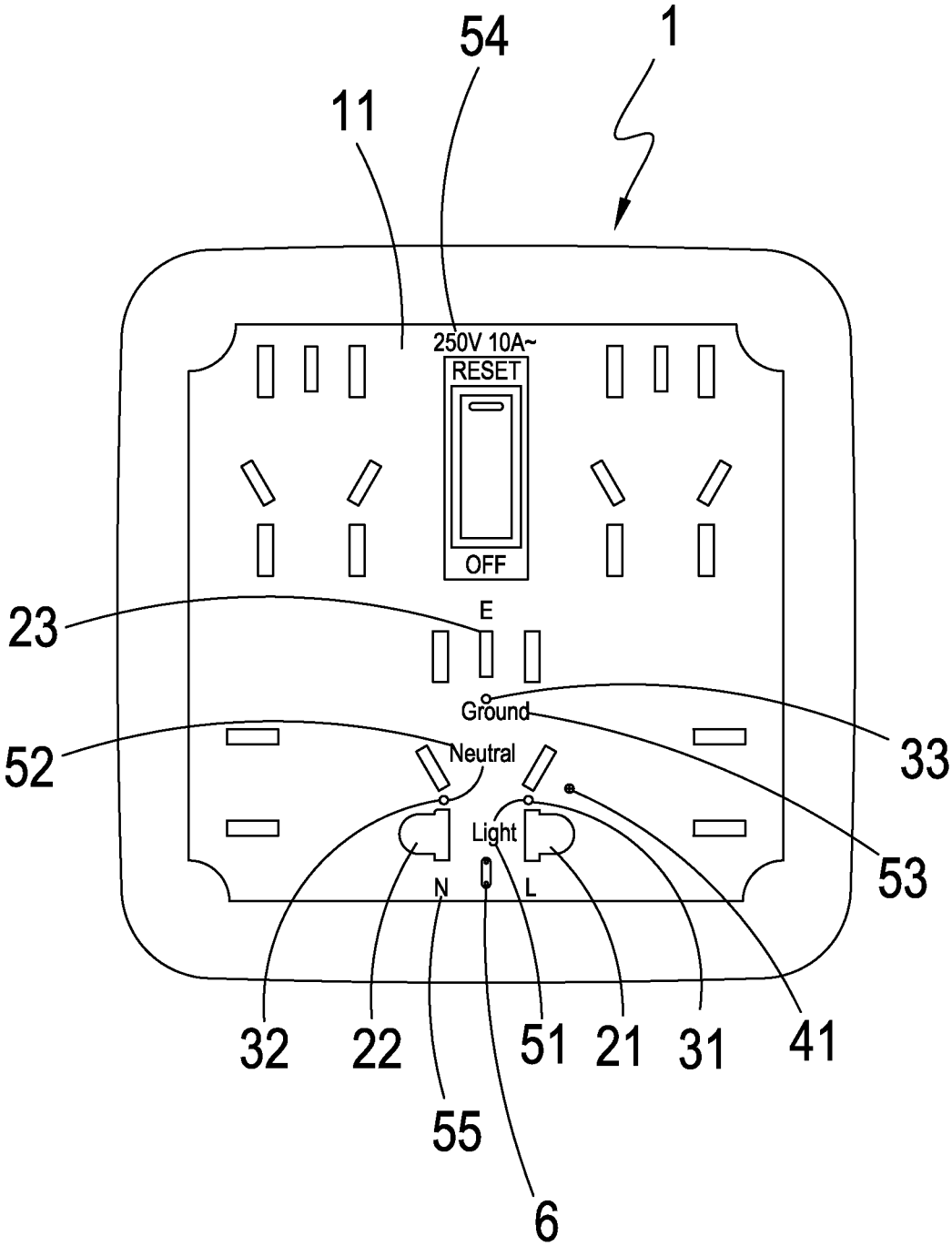
FIG. 1A is a schematic view showing a first preferred embodiment of the present invention.
Figure 1B:
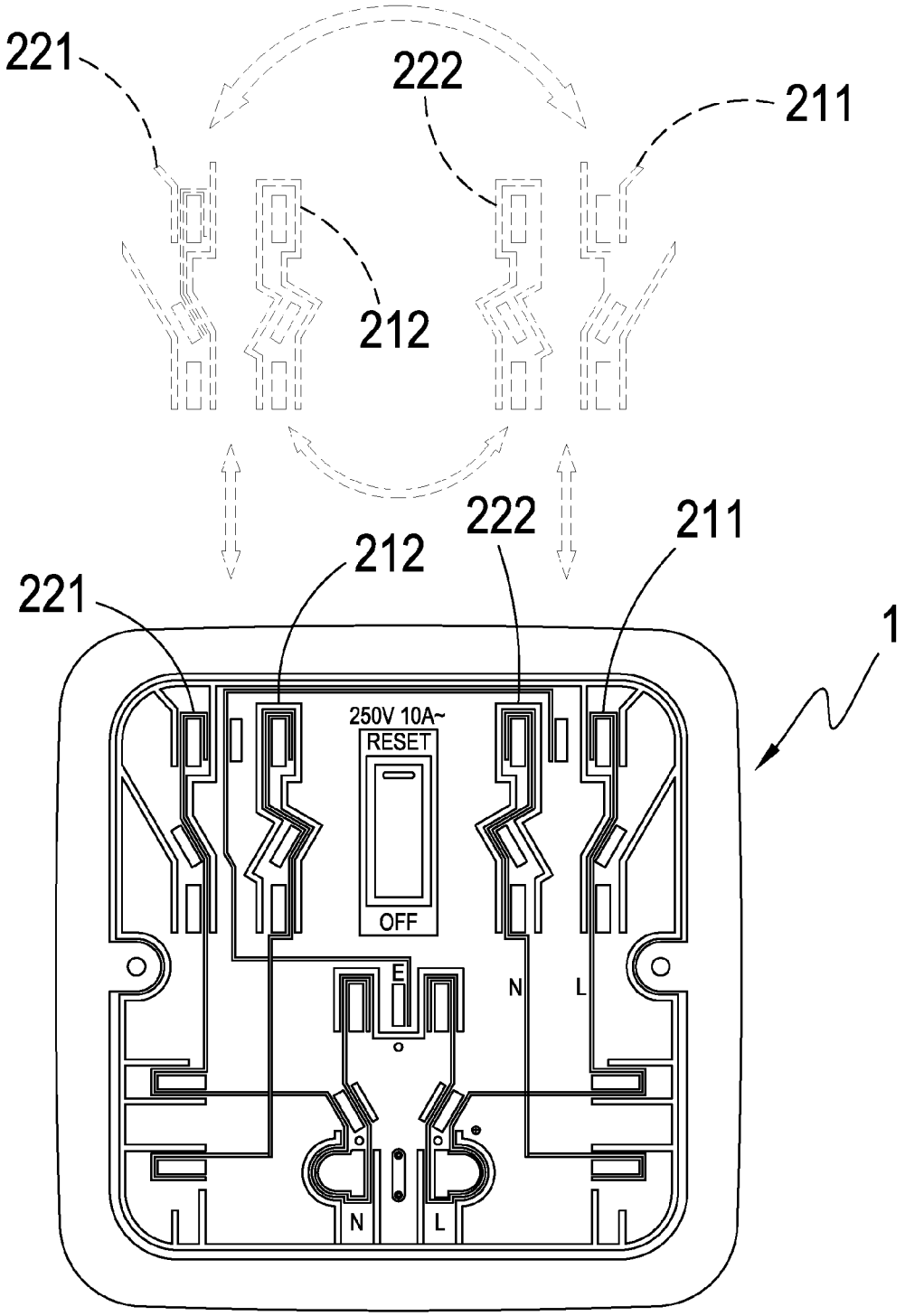
FIG. 1B is a schematic view showing an arrangement of terminals of the first preferred embodiment of the present invention.

Referring to FIGS. 1A and 1B, it can be clearly seen that the present invention comprises an insert-to-connect device body 1. The insert-to-connect device body 1 can be one of a receptacle and an adaptor. The insert-to-connect device body 1 can be mounted to all sorts of equipment and instruments (not shown) for polarity detection for two-wire, three-wire, or industrial multiple-wire applications. The insert-to-connect device body is provided therein with at least one grounding terminal 23 serving as E pole, at least one transmission terminal 22 arranged at the left side of the grounding terminal 23 and at least one conduction terminal 21 arranged at the right side of the grounding terminal 23. When the intelligent receptacle adaptor is connected to a power source having a voltage level of 250V, the transmission terminal 22 is N pole and the conduction terminal 21 is L pole, namely N pole at left and L pole at right. In the instant embodiment, illustration will be given with reference to a receptacle connected to a voltage of 250V, and under such a condition, the grounding terminal 23 is E pole, the transmission terminal 22 is N pole, and the conduction terminal 21 is L pole. Further, the grounding terminal 23 is electrically connected with at least one grounding bulb 33; the transmission terminal 22 is electrically connected with at least one transmission bulb 32; the conduction terminal 21 is electrically connected with at least one conduction bulb 31; and the conduction terminal 21 is electrically connected with at least one conduction touch-plate 41. Thus, when the intelligent receptacle adaptor is connected to a power source, whether the polarities are correctly set and positioned can be determined according to if the grounding bulb 33 is lit up, or alternatively, whether the polarities are correctly set and positioned can be determined according to if the conduction bulb 31 is lit up after the conduction touch-plate 41 has been touched. Further, the insert-to-connect device body 1 further comprises at least one universal surface panel 11 for receiving the insertion of standard plugs of different countries so that the standard plugs can be electrically connected with the grounding terminal 23, the transmission terminal 22, or the conduction terminal 21. Further, at least one grounding plate 6 is arranged between the transmission terminal 22 and the conduction terminal 21 for grounding when a German or French style plug is inserted. The insert-to-connect device body 1 is further provided with a conduction text section 51 that is adjacent to the conduction bulb 31, a transmission text section 52 that is adjacent to the transmission bulb 32, and a grounding text section 53 that is adjacent to the grounding bulb 33. Further, the present invention further defines at least one voltage text section 54 for indicating the consumers with the voltage level that is being used and at least one polarity text section 55 for indicating the consumers with correct polarity.

To install, the insert-to-connect device body 1 is electrically connected with a power source first. Under this condition, if the grounding bulb 33 is lit up, it is determined that E pole of the power source is correctly set in position; if the transmission bulb 32 is lit up, it is determined that N pole of the power source is correctly set in position; if the conduction bulb 31 is lit up after the conduction touch-plate 41 has been touch, it is determined that L pole of the power source is correctly set in position. In this way, on-site detection can be performed without any tool and a user may detect and identify, in an easy and efficient manner without using any tool, if the connection of electrical polarity of the power source made by an installation operator is correct.

Further, as shown in FIG. 1B, in the instant embodiment, the insert-to-connect device body 1 is further provided therein with a first transmission terminal 221, a second transmission terminal 222*m* a first conduction terminal 211, and the second conduction terminal 212. The first conduction terminal 211 and the first transmission terminal 221 can be switched with each other and commonly used. In other words, the first conduction terminal 211 can be mounted and used as the first transmission terminal 221. Further, the second transmission terminal 222 and the second conduction terminal 212 can be switched with each other and commonly used. In other words, the second transmission terminal 222 can be mounted and used as the second conduction terminal 212.

Figure 2A:
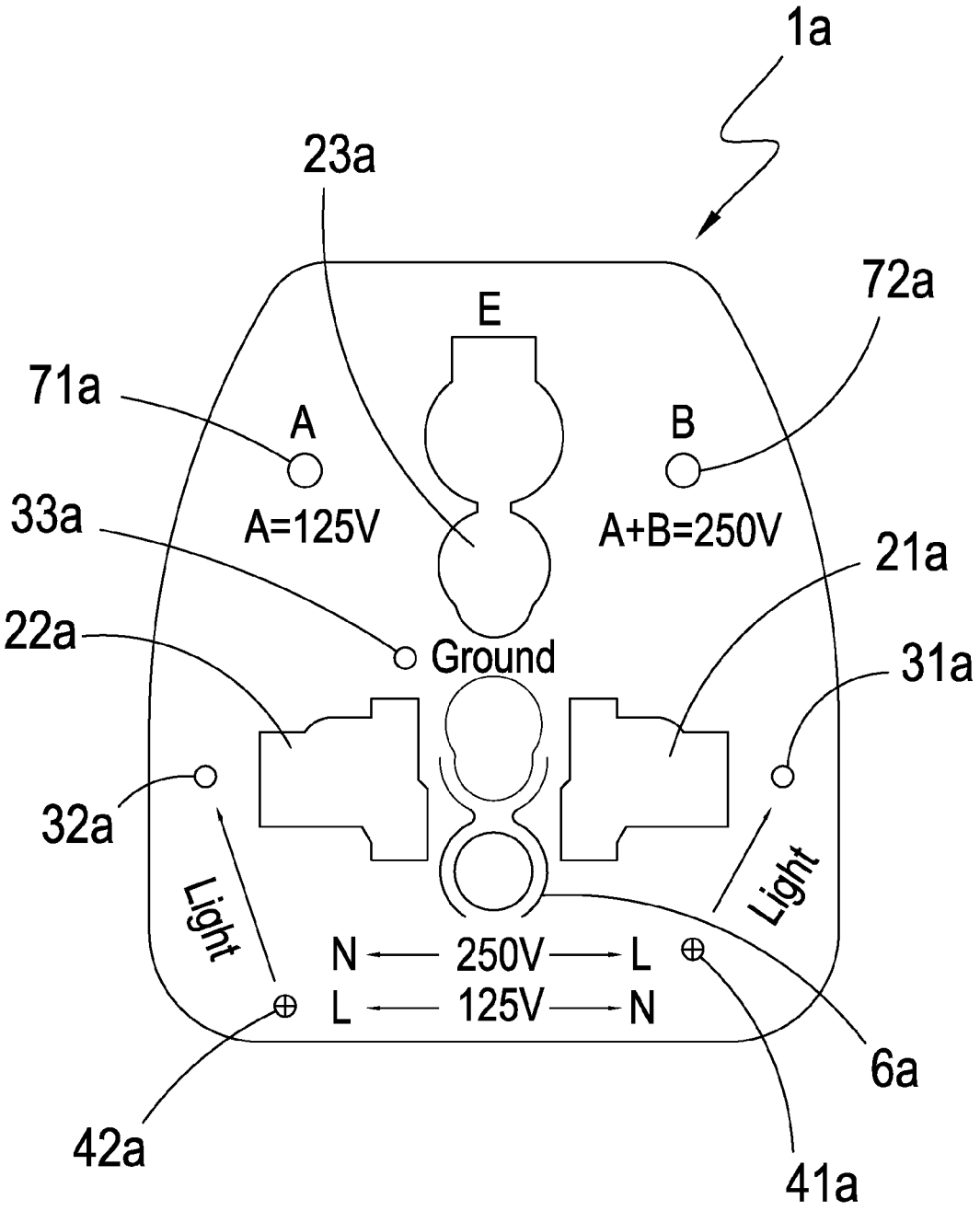
FIG. 2A is a schematic view showing an adaptor according to a second preferred embodiment of the present invention.
Figure 2B:
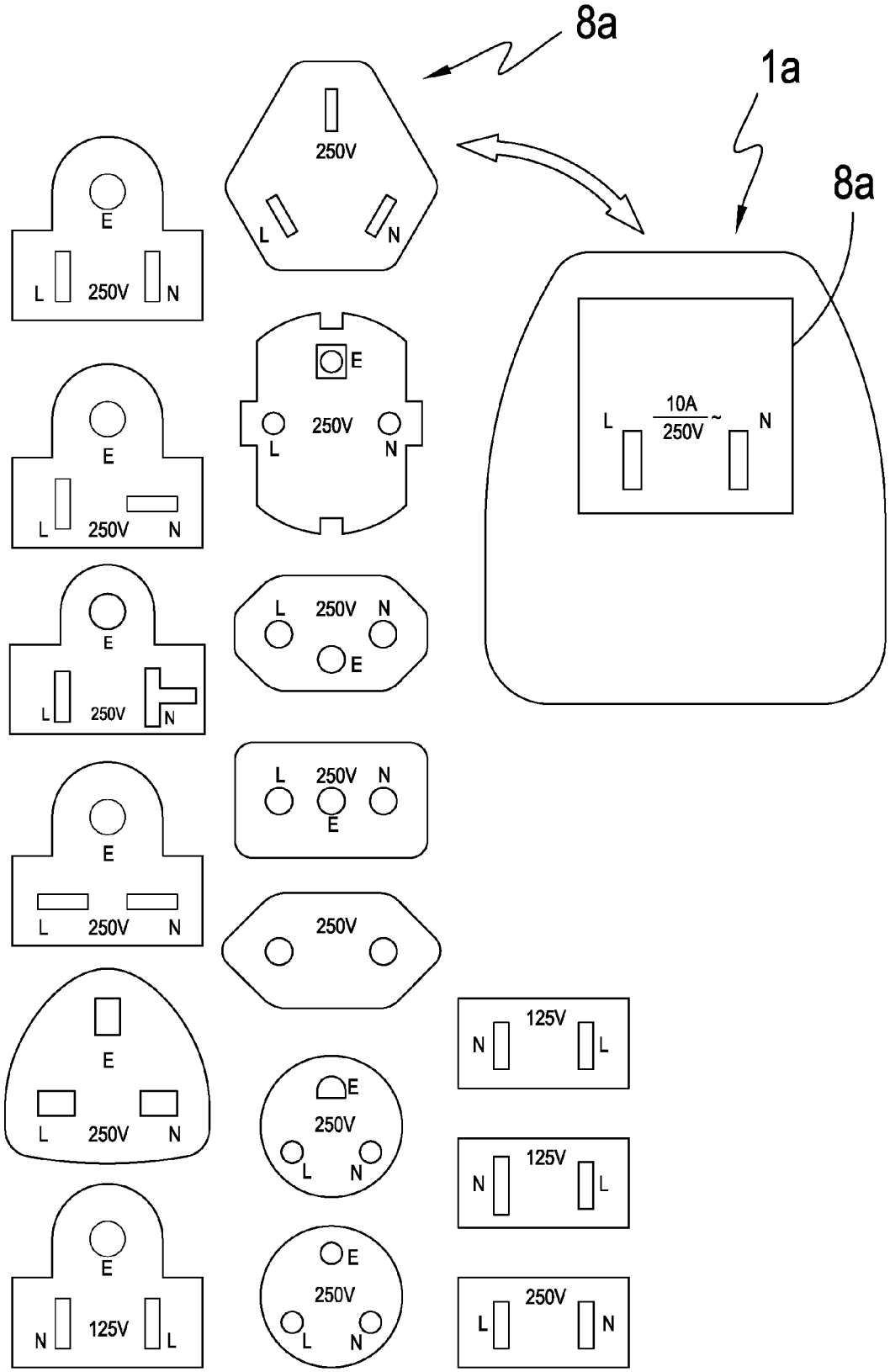
FIG. 2B is a schematic view showing insertion terminal sets of the second preferred embodiment of the present invention.
Figure 2C:
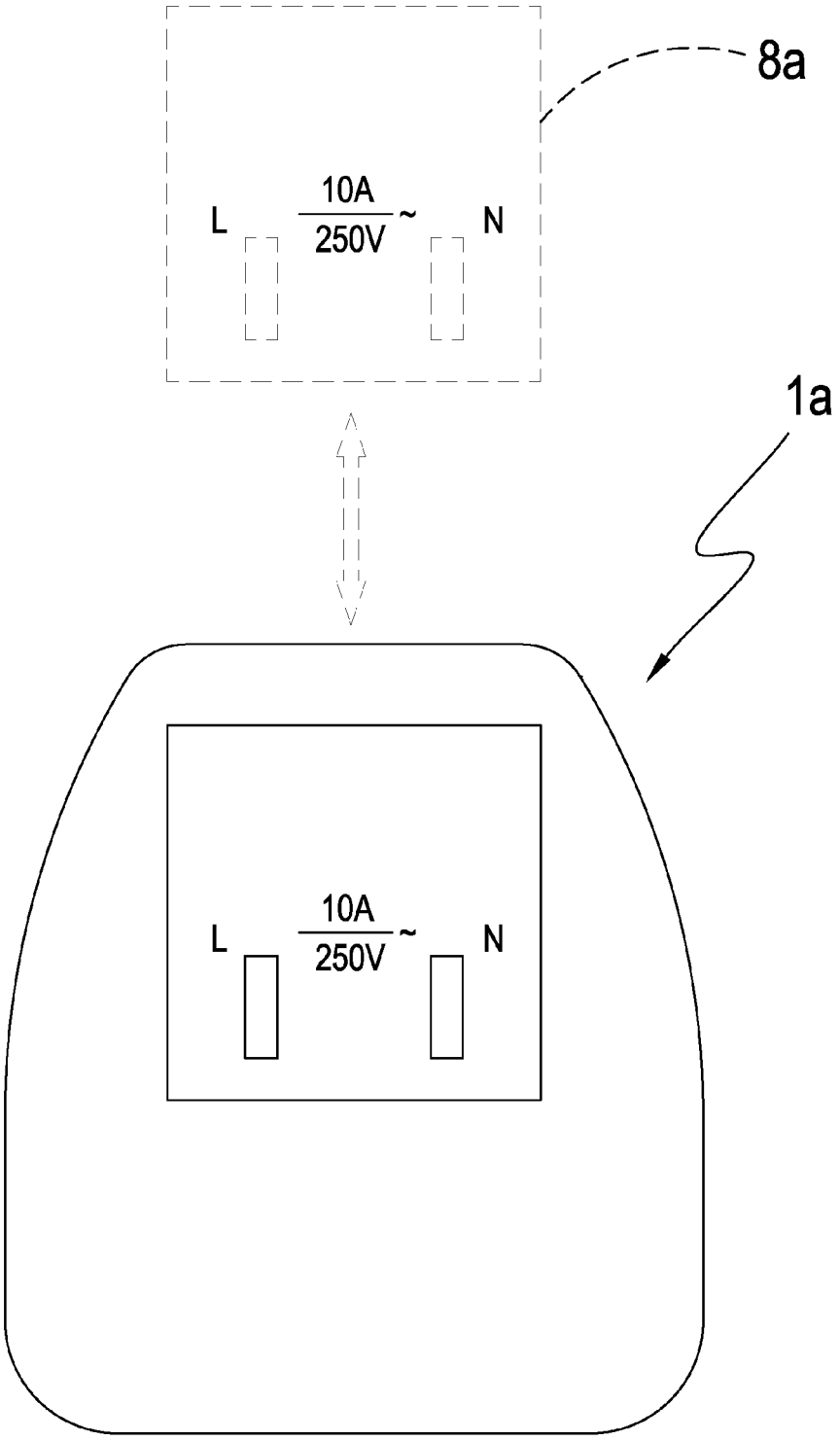
FIG. 2C is a schematic view showing the second preferred embodiment in a detached condition.
Figure 3A:
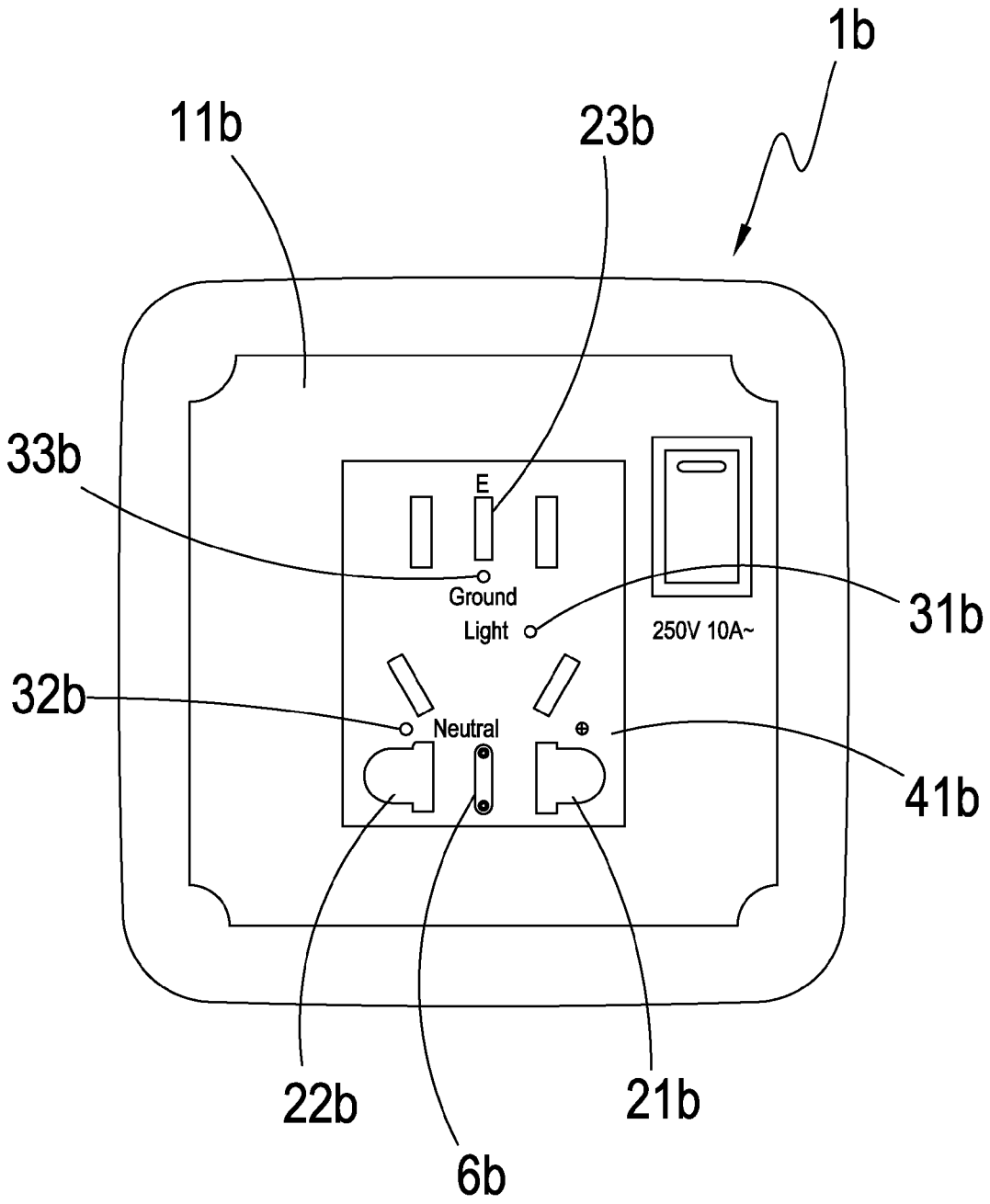
FIG. 3A is a schematic view showing a first example of a third preferred embodiment.
Figure 3B:
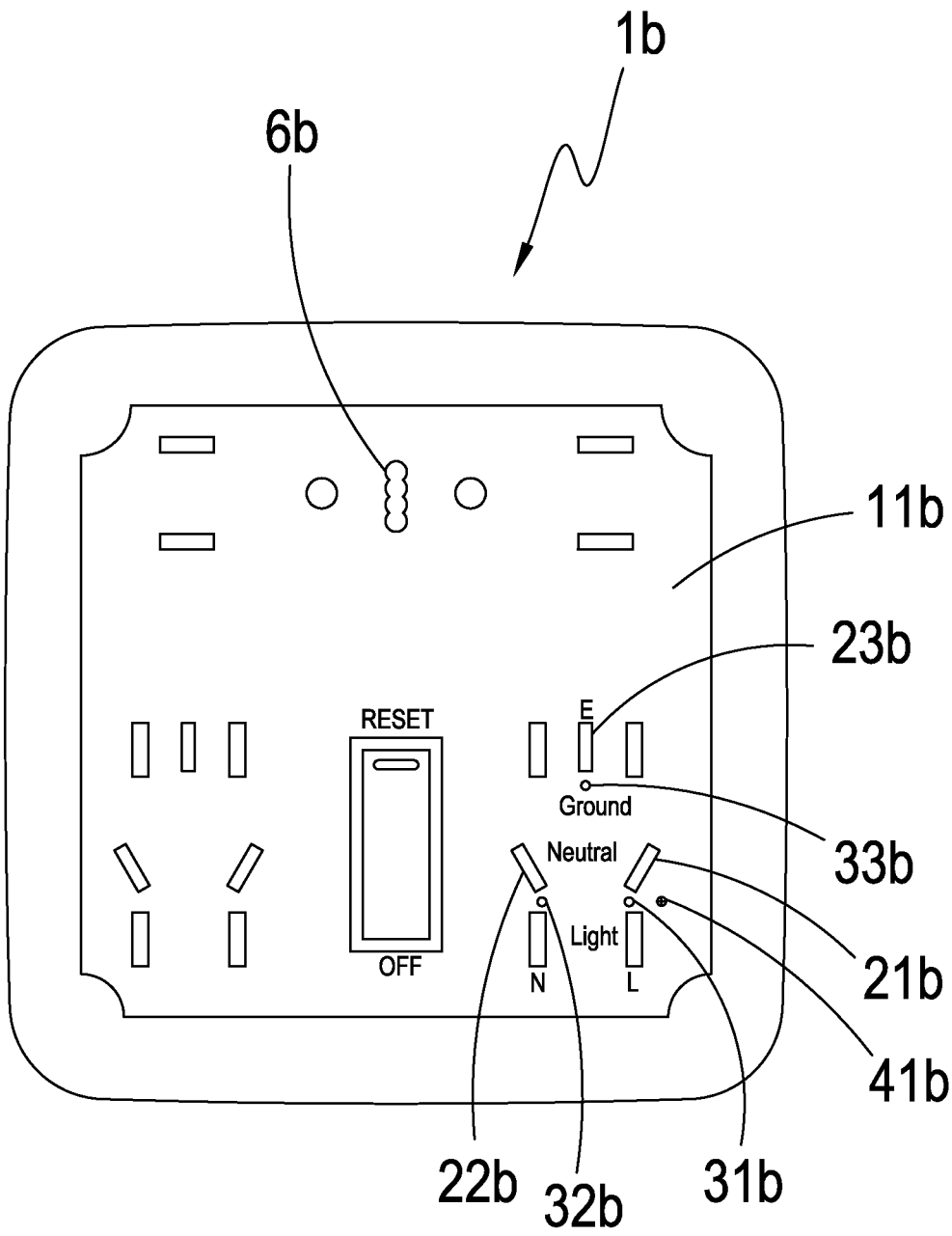
FIG. 3B is a schematic view showing a second example of the third preferred embodiment.
Figure 3C:
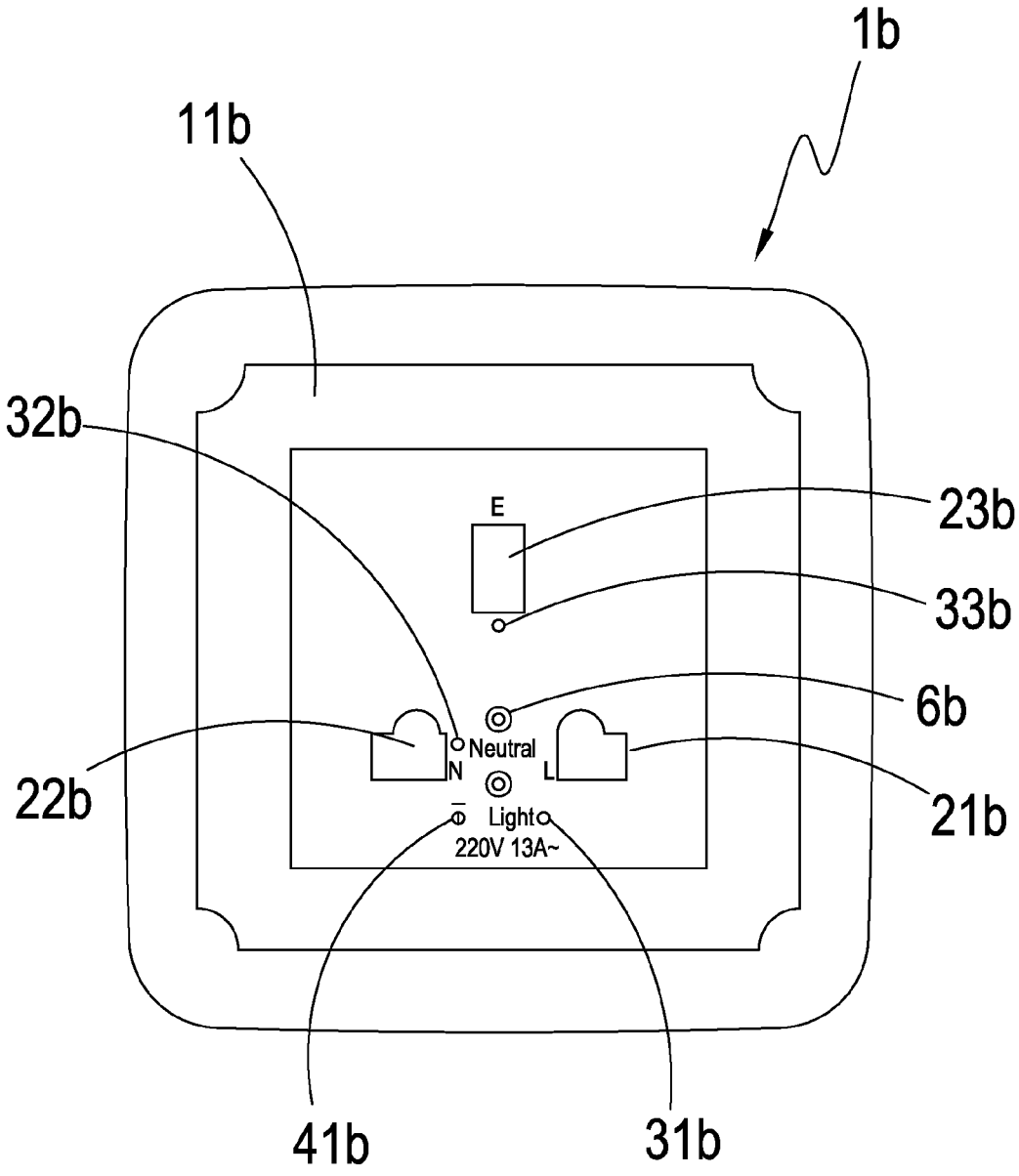
FIG. 3C is a schematic view showing a third example of the third preferred embodiment.
Figure 3D:
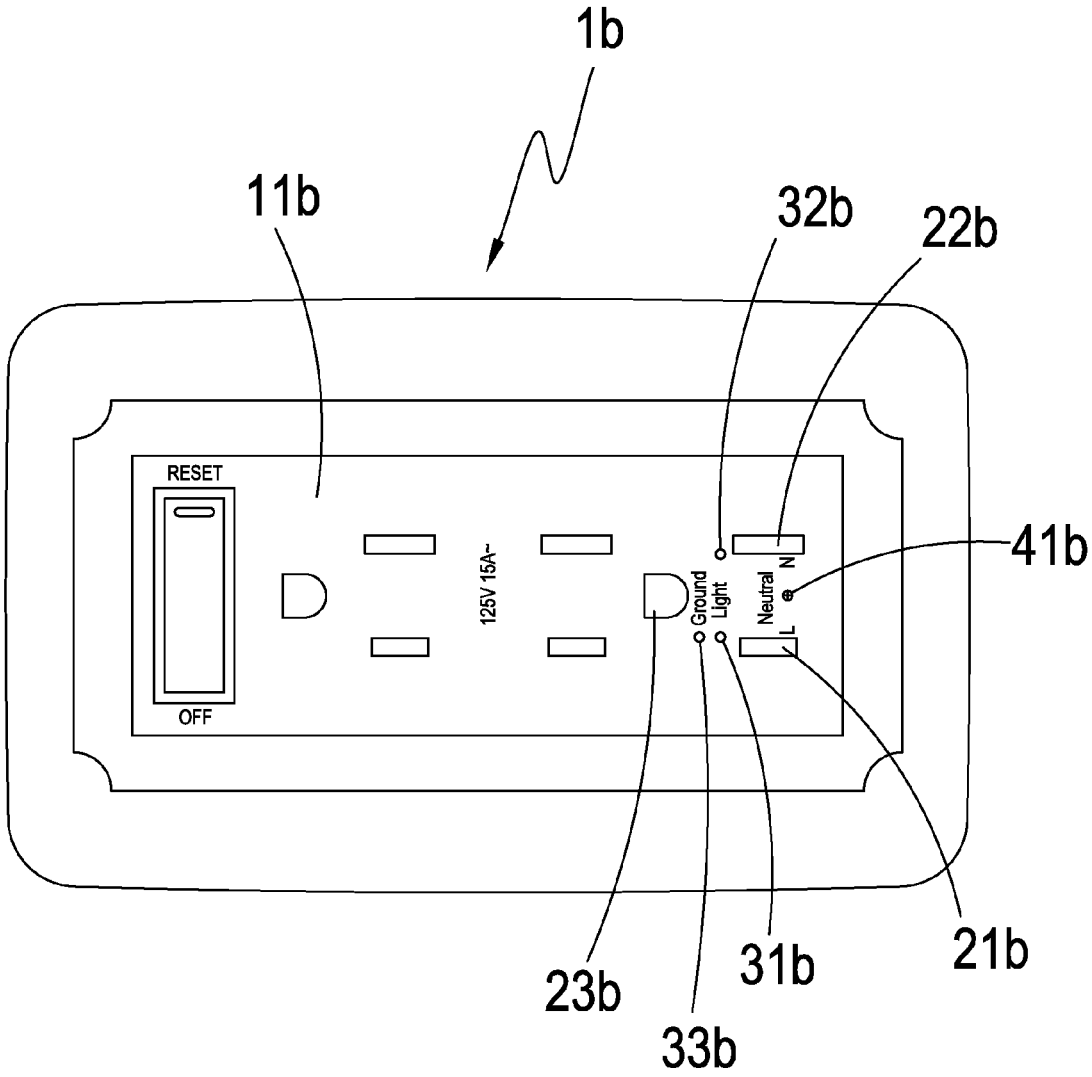
FIG. 3D is a schematic view showing a fourth example of the third preferred embodiment.
Figure 3E:
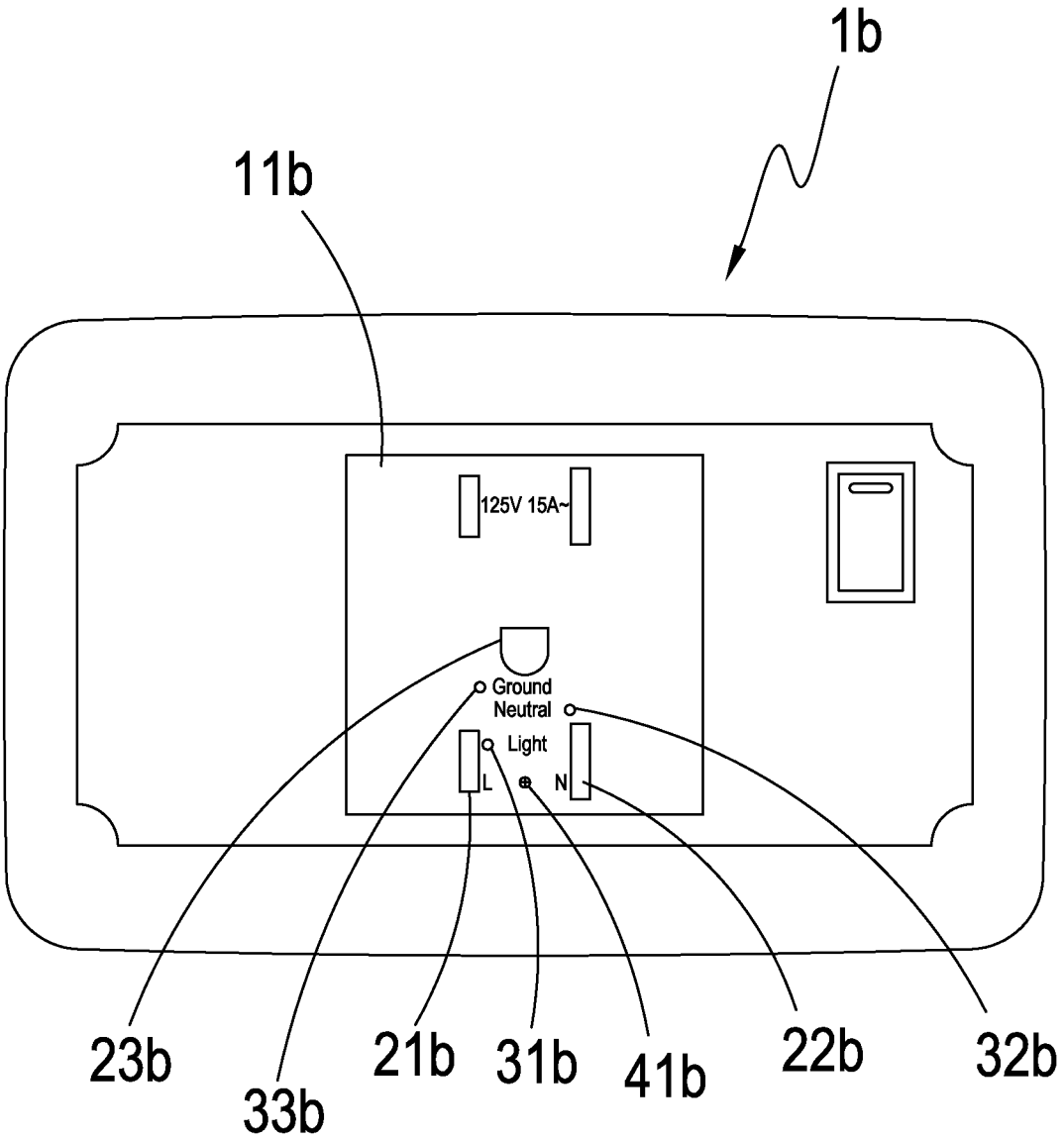
FIG. 3E is a schematic view showing a fifth example of the third preferred embodiment.
Figure 3F:
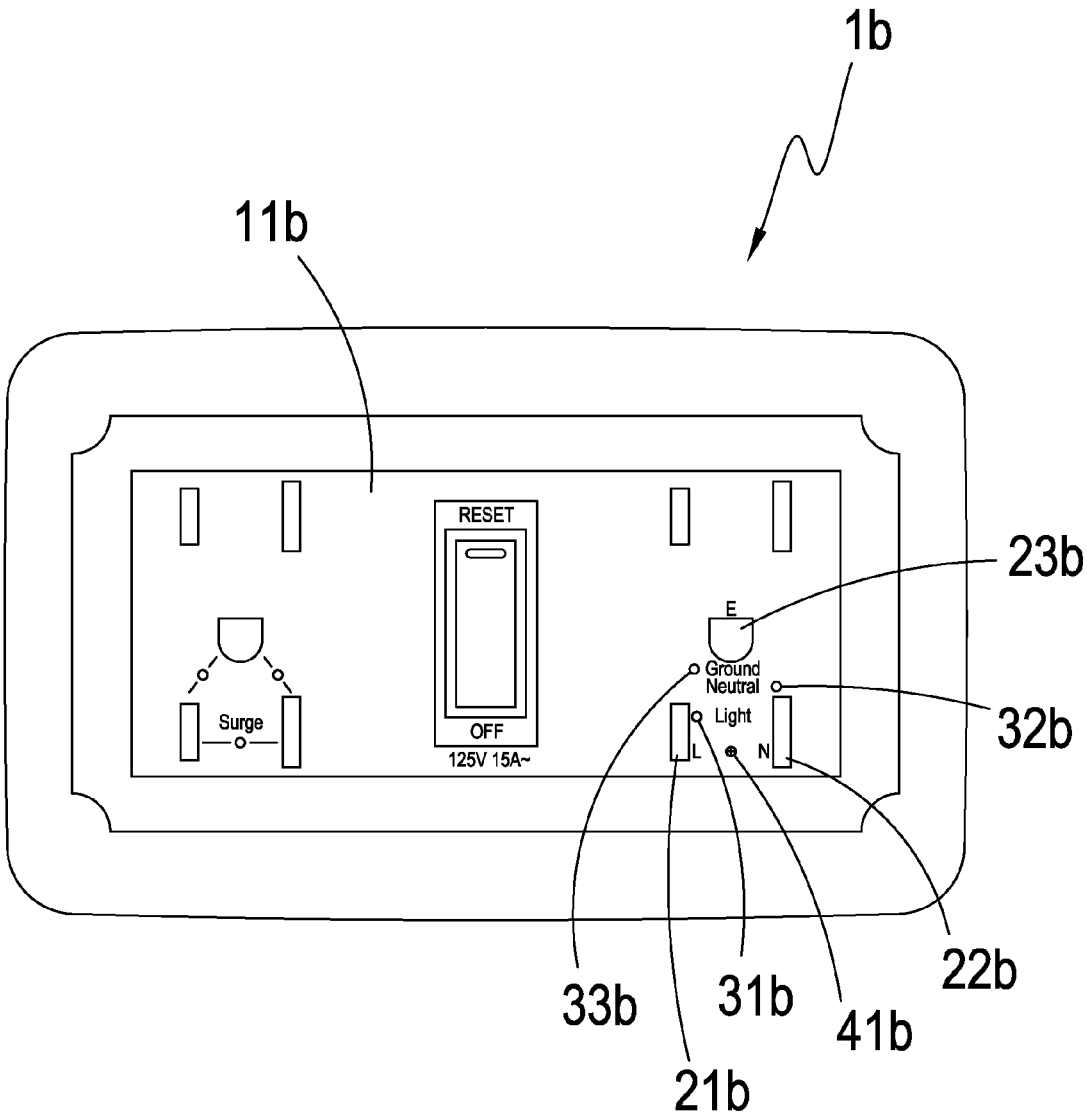
FIG. 3F is a schematic view showing a sixth example of the third preferred embodiment.
Figure 3G:
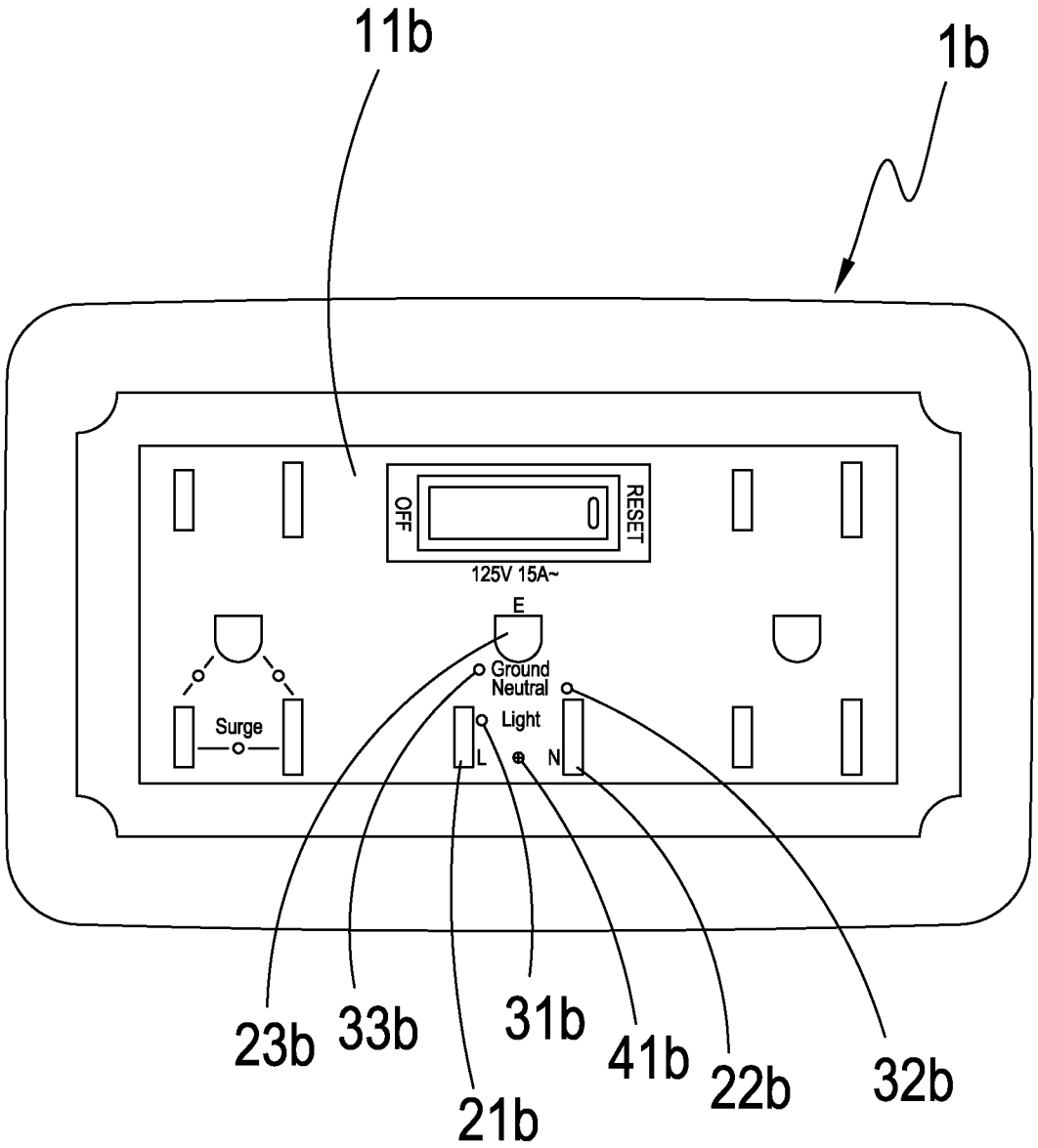
FIG. 3G is a schematic view showing a seventh example of the third preferred embodiment.
Figure 3H:
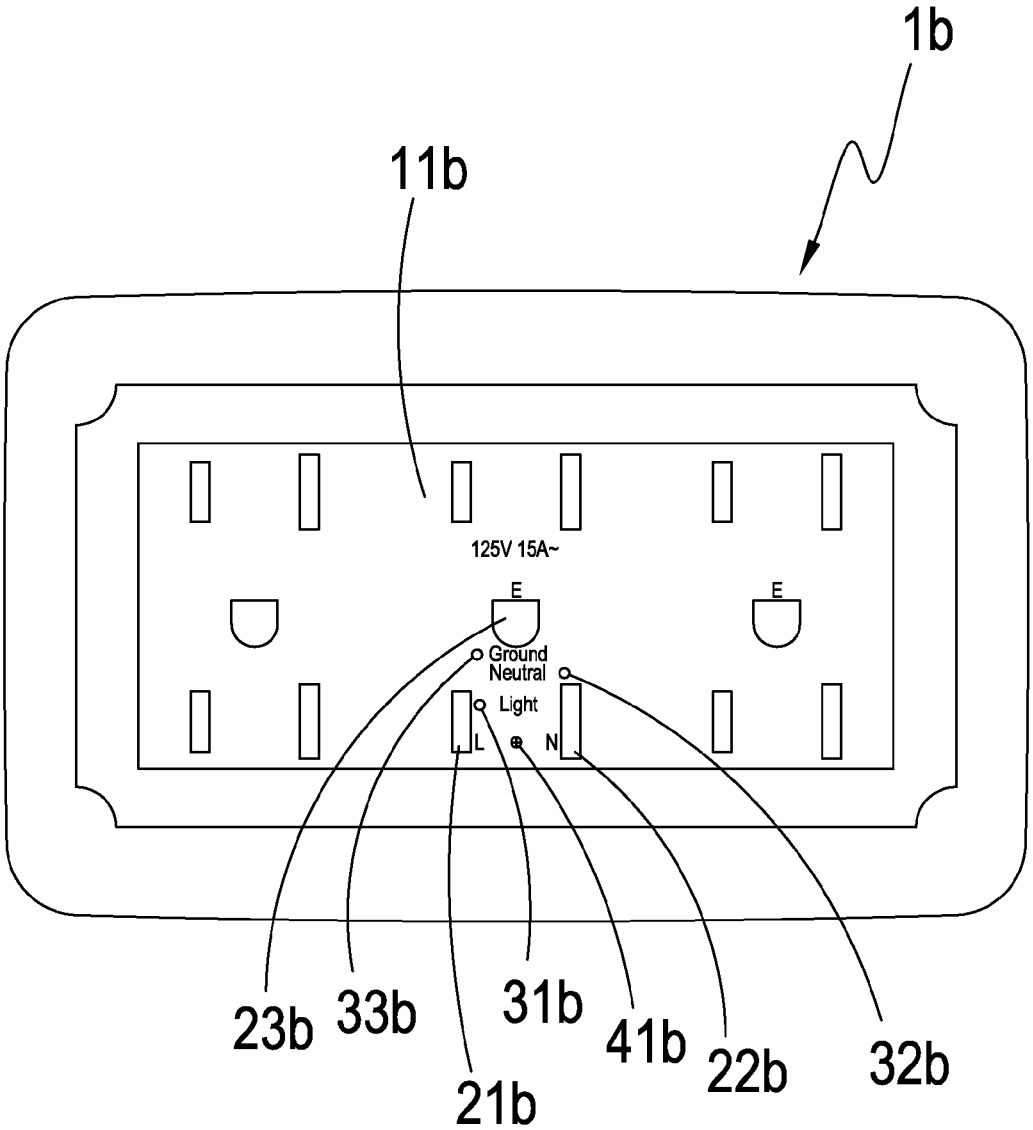
FIG. 3H is a schematic view showing an eighth example of the third preferred embodiment.
Figure 3I:
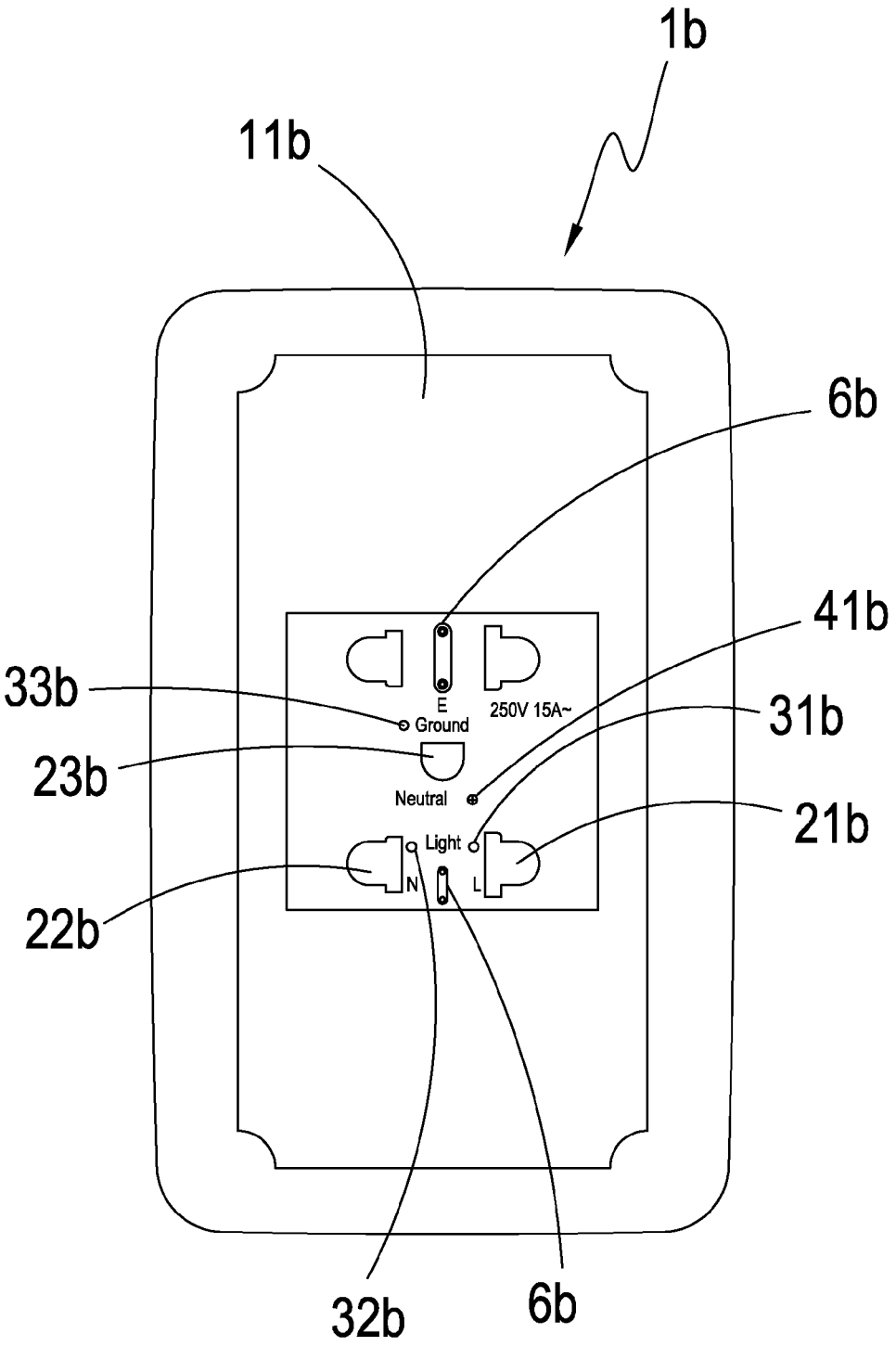
FIG. 3I is a schematic view showing a ninth example of the third preferred embodiment.
Figure 3J:
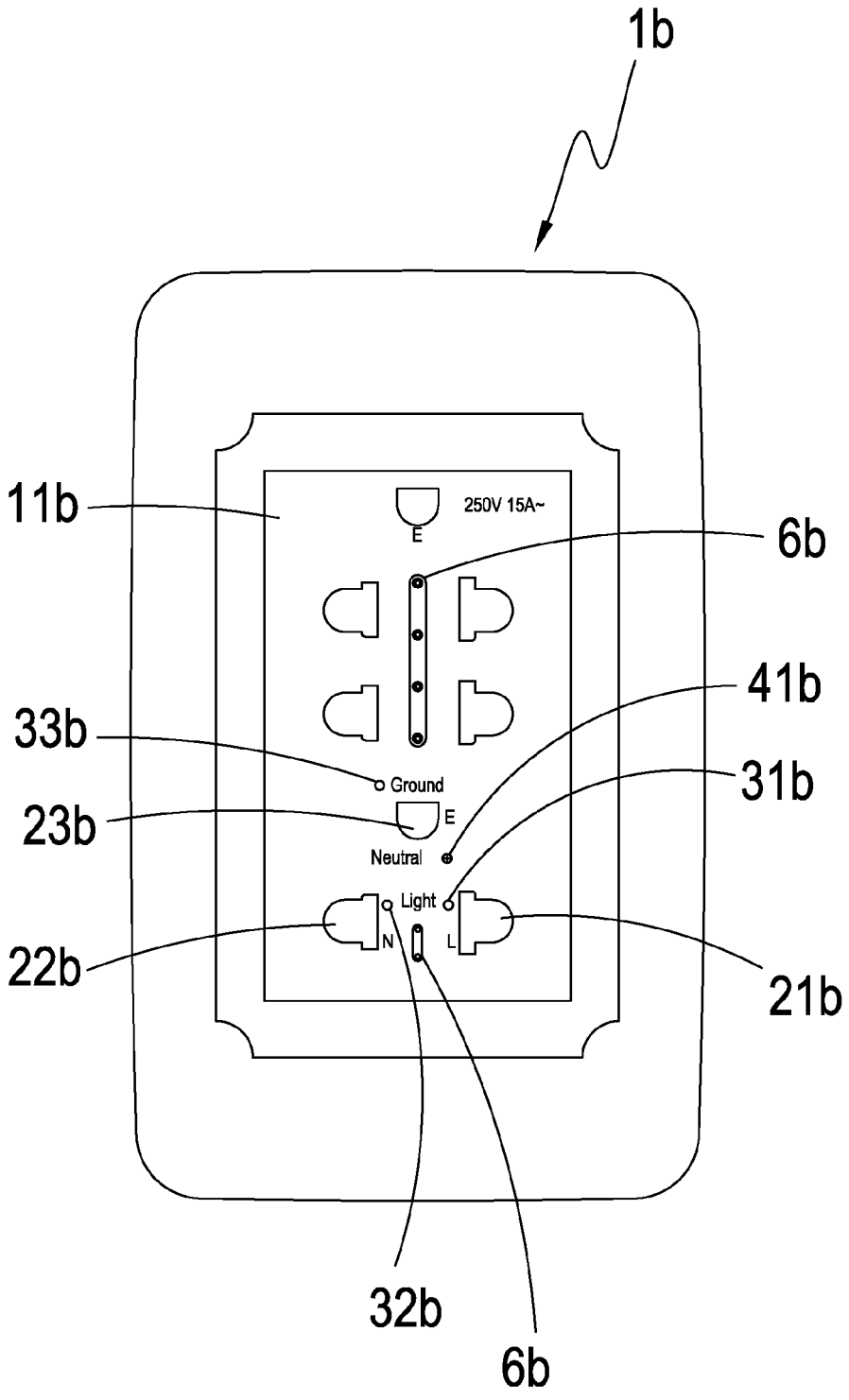
FIG. 3J is a schematic view showing a tenth example of the third preferred embodiment.

As shown in FIGS. 2A-2C, these drawings clearly show the present invention comprises an insert-to-connect device body 1*a*. The insert-to-connect device body 1*a* is provided therein with at least one grounding terminal 23*a* serving as E pole, at least one transmission terminal 22*a* arranged at the left side of the grounding terminal 23*a*, and at least one conduction terminal 21*a* arranged at the right side of the grounding terminal 23*a*. The grounding terminal 23*a* is electrically connected with at least one grounding bulb 33*a*; the transmission terminal 22*a* is electrically connected with at least one transmission bulb 32*a*; the conduction terminal 21*a* is electrically connected with at least one conduction bulb 31*a*; the conduction terminal 21*a* is electrically connected with at least one conduction touch-plate 41*a*; and at least one grounding plate 6*a* is arranged between the transmission terminal 22*a* and the conduction terminal 21*a*. Differences of the instant embodiment from the previous embodiment are that in the instant embodiment, illustration is given with reference to an adaptor as an example of the insert-to-connect device body 1*a* and the insert-to-connect device body 1*a* is further provided with a first light emission element 71*a* and a second light emission element 72*a* and the transmission terminal 22*a* is electrically connected with at least one transmission touch-plate 42*a*.

When the insert-to-connect device body 1*a* is electrically connected with a power source, if the first light emission element 71*a* is lit up, it is determined that the voltage level of the power source is 125V and if the first light emission element 71*a* and the second light emission element 72*a* are lit up simultaneously, it is determined that the voltage level of the power source is 250V. In this way, a user can be reminded of the voltage level that is being used.

When the insert-to-connect device body 1*a* is connected to a power source having a voltage level of 250V, if the conduction bulb 31*a* is lit up when the conduction touch-plate 41*a* is touched, then the transmission terminal 22*a* is (left side) N pole and the conduction terminal 21*a* is (right side) L pole; and when the insert-to-connect device body 1*a* is connected to a power source of a voltage level of 125V, if the transmission bulb 32*a* is lit up when the transmission touch-plate 42*a* is touched, then the transmission terminal 22*a* is (left side) L pole and the conduction terminal 21*a* is (right side) N pole. In this way, when a user attempts to insert a device plug (not shown) into the insert-to-connect device body 1*a* to receive a supply of power, the voltage level that is connected and supplied can be determined to be 125V or 250V according to the lighting of the transmission bulb 32*a* or the conduction bulb 31*a*. When the voltage level is indicated to be 250V, L pole (fire wire) of the device plug is inserted into the conduction terminal 21*a* (right side); or alternatively, when the voltage level is indicated to be 125V, L pole (fire wire) of the device plug is inserted into the transmission terminal 22*a* (left side), whereby the user can be guided to insert the device plug according to the correct polarity.

As shown in FIG. 2B, the insert-to-connect device body 1*a* is provided, on at least one side thereof, with an insertion terminal set 8*a* that is in compliance with different standards of different countries.

As shown in FIG. 2C, the insertion terminal set 8*a* is selectively detachable from the insert-to-connect device body 1*a*.

As shown in FIGS. 3A-3J, these drawings clearly show the present invention comprises an insert-to-connect device body 1*b*. The insert-to-connect device body 1*b* further comprises at least one universal surface panel 11*b* for receiving the insertion of various standard plugs of different countries, such as South Africa. The insert-to-connect device body 1*b* is provided therein with at least one grounding terminal 23*b* serving as E pole, at least one transmission terminal 22*b* arranged at the left side of the grounding terminal, and at least one conduction terminal 21*b* arranged at the right side of the grounding terminal. The conduction terminal 21*b* is electrically connected with at least one conduction bulb 31*b* and at least one conduction touch-plate 41*b*; the transmission terminal 22*b* is electrically connected with at least one transmission bulb 32*b*; the grounding terminal 23*b* is electrically connected with at least one grounding bulb 33*b*; and at least one grounding plate 6*b* is selectively arranged between the transmission terminal 22*b* and the conduction terminal 21*b*. A difference from the previous embodiments is that the instant embodiment is composed of various combinations.

Figure 4:
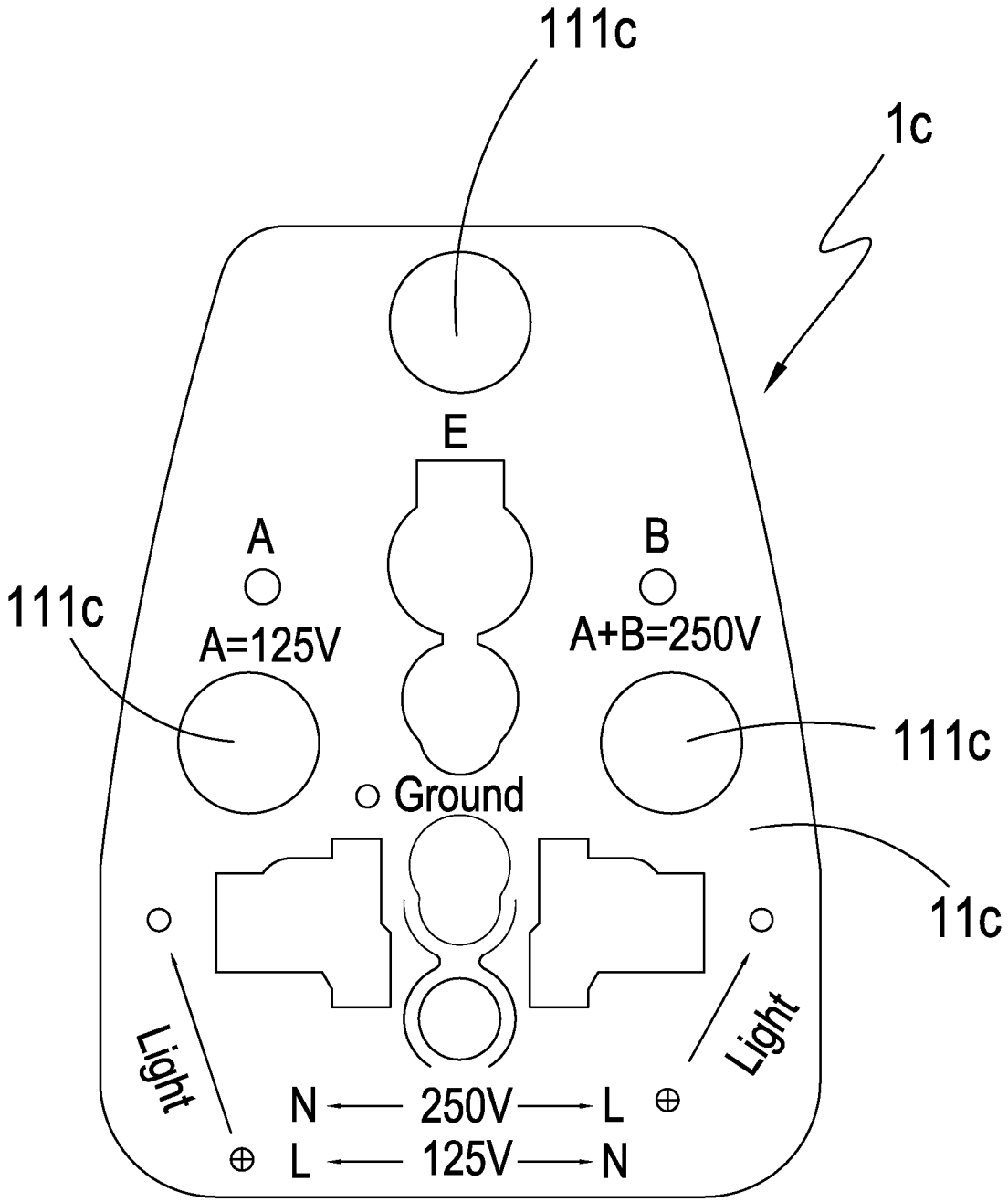
FIG. 4 is a schematic view showing a fourth preferred embodiment.

As shown in FIG. 4, the drawing clearly shows that the present invention comprises an insert-to-connect device body 1*c*. The insert-to-connect device body 1*c* further comprises at least one universal surface panel 11*c*. A difference from the previous embodiments is that in the instant embodiment, the universal surface panel 11*c* is further formed with a plurality of special insertion holes 111*c* for the insertion of the so-called big South African plug.

Thus, the technical features that the present invention adopts to improve the drawbacks of the prior art are as follows:

providing reminders to a construction operator to prevent incorrect wire laying and to allow for inspection and test after the completion of the construction;

preventing incorrect polarity connection in inserting a plug and allowing for detection of incorrect setting of polarity for power receptacles;

being operable without any tool in all types of applications, making the inspection easy and transparent and detection of polarity;

reducing electromagnetic wave and radioactive dust;

preventing occurrence of electrical leaking due to incorrect connection; and teaching and improving safety knowledge of construction operators and users to correctly use electrical power.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. A polarity-correctly-connectable intelligent receptacle adaptor, comprising an insert-to-connect device body, the insert-to-connect device body comprising at least one grounding terminal serving as E pole, at least one transmission terminal arranged at the left side of the grounding terminal, and at least one conduction terminal arranged at the right side of the grounding terminal wherein when the intelligent receptacle adaptor is connected to a power source having a voltage level of 250V, the transmission terminal is N pole and the conduction terminal is L pole, which is an arrangement of N pole at left and L pole at right; and when the intelligent receptacle adaptor is connected to a power source having a voltage level of 125V, the transmission terminal is L pole and the conduction terminal is N pole, which is an arrangement of L pole at left and N pole at right; and wherein the grounding terminal is electrically connected with at least one grounding bulb; the transmission terminal is electrically connected with at least one transmission bulb; the conduction terminal is electrically connected with at least one conduction bulb; and the conduction terminal is electrically connected with at least one conduction touch-plate, whereby when the intelligent receptacle adaptor is connected to a power source, whether the polarities are correctly set and positioned can be determined according to if the grounding bulb is lit up, or alternatively, whether the polarities are correctly set and connected can be determined according to if the conduction bulb is lit up after the conduction touch-plate has been touched; and wherein the insert-to-connect device body further comprises at least one universal surface panel for receiving the insertion of standard plugs of different countries so that the standard plugs are electrically connectable with the grounding terminal, the transmission terminal, or the conduction terminal.

2. The polarity-correctly-connectable intelligent receptacle adaptor according to claim 1, wherein when the insert-to-connect device body is electrically connected with a power source first, if the grounding bulb is lit up, it is determined that pole of the power source is correctly set in position; if the transmission bulb is lit up, it is determined that N pole of the power source is correctly set in position; if the conduction bulb is lit up after the conduction touch-plate has been touch, it is determined that L pole of the power source is correctly set in position.

3. The polarity-correctly-connectable intelligent receptacle adaptor according to claim 1, wherein the insert-to-connect device body comprises a conduction text section that is adjacent to the conduction bulb, a transmission text section that is adjacent to the transmission bulb, and a grounding text section that is adjacent to the grounding bulb.

4. The polarity-correctly-connectable intelligent receptacle adaptor according to claim 1, wherein at least one grounding plate is arranged between the transmission terminal and the conduction terminal for grounding when a German or French style plug is inserted.

5. The polarity-correctly-connectable intelligent receptacle adaptor according to claim 1, wherein the insert-to-connect device body comprises a first transmission terminal, a second transmission terminal, a first conduction terminal, and a second conduction terminal, the first conduction terminal and the first transmission terminal being switchable with each other for common use, the second transmission terminal and the second conduction terminal being switchable with each other for common use.

6. The polarity-correctly-connectable intelligent receptacle adaptor according to claim 1, wherein the insert-to-connect device body is selectively one of a receptacle and an adaptor, the insert-to-connect device body being mountable to all sorts of equipment and instruments for polarity detection for two-wire, three-wire, or industrial multiple-wire applications.

7. The polarity-correctly-connectable intelligent receptacle adaptor according to claim 6, wherein when being an adaptor, the insert-to-connect device body is provided, on at least one side thereof, with an insertion terminal set that is in compliance with different standards of different countries, the insertion terminal set being selectively detachable from the insert-to-connect device body.

8. The polarity-correctly-connectable intelligent receptacle adaptor according to claim 1, wherein the insert-to-connect device body is provided with a first light emission element and a second light emission element and when the insert-to-connect device body is electrically connected with a power source, if the first light emission element is lit up, it is determined that the voltage level of the power source is 125V and if the first light emission element and the second light emission element are lit up simultaneously, it is determined that the voltage level of the power source is 250V.

9. The polarity-correctly-connectable intelligent receptacle adaptor according to claim 1, wherein the conduction touch-plate is arranged at the right side of the grounding terminal and the transmission terminal is electrically connected with at least one transmission touch-plate, the transmission touch-plate being arranged at the left side of the grounding terminal, whereby when the insert-to-connect device body is connected to a power source having a voltage level of 250V, touching the transmission touch-plate at the right side causes the transmission bulb to light and when the insert-to-connect device body is connected to a power source having a voltage level of 125V, touching the conduction touch-plate at the left side causes the conduction bulb to light.

* * * * *